United States Patent [19]

Güntert et al.

[11] Patent Number: 4,850,822

[45] Date of Patent: Jul. 25, 1989

[54] FUEL INJECTION PUMP FOR INTERNAL COMBUSTION ENGINES

[75] Inventors: Josef Güntert, Gerlingen; Walter Häfele, Fellbach; Johann Warga, Bietigheim-Bissingen, all of Fed. Rep. of Germany

[73] Assignee: Robert Bosch GmbH, Stuttgart, Fed. Rep. of Germany

[21] Appl. No.: 130,231

[22] PCT Filed: Mar. 19, 1987

[86] PCT No.: PCT/DE87/00120

§ 371 Date: Oct. 13, 1987

§ 102(e) Date: Oct. 13, 1987

[87] PCT Pub. No.: WO87/05970

PCT Pub. Date: Oct. 8, 1987

[30] Foreign Application Priority Data

Mar. 24, 1986 [DE] Fed. Rep. of Germany ..... 3610928
Sep. 9, 1986 [DE] Fed. Rep. of Germany ..... 3630647

[51] Int. Cl.[4] ..... F02M 59/24; F02M 59/44

[52] U.S. Cl. ..... 417/499

[58] Field of Search ..... 417/494, 499; 123/501, 123/500, 503

[56] References Cited

U.S. PATENT DOCUMENTS 4,661,051 4/1987 Nakamura ..... 417/499

FOREIGN PATENT DOCUMENTS 1132382 6/1962 Fed. Rep. of Germany ..... 417/494

*Primary Examiner*—Leonard E. Smith
*Attorney, Agent, or Firm*—Michael J. Striker

[57] ABSTRACT

Fuel injection pump for internal combustion engines with at least one pump element and a control slide valve, axially displaceable on the pump piston, and, for fuel control, additionally the twistable pump piston, the control slide valve being secured against self-twisting by a lug, which is guided in a slit-shaped groove of the cylinder sleeve of the pump element.

9 Claims, 2 Drawing Sheets

FUEL INJECTION PUMP FOR INTERNAL COMBUSTION ENGINES

BACKGROUND OF THE INVENTION

The invention relates to a fuel injection pump. With such lifting slide-valve pumps, the volume control or the beginning of injection control is effected by the control of ports via which the pump working space can be connected to the suction space of the pump, namely by the assignment of control edges lying on the pump piston to the control edges lying in the control slide valve. For this reason, the rotational position of the control slide valve with respect to the cylinder liner must be fixed, with the result that, on the one hand, the control slide valve maintains a certain fixed rotational position in relation to the twistable pump piston and that, on the other hand, during basic adjustment, which is effected by slight twisting of the cylinder liner, which is subsequently clamped, the control slide valve is turned with it.

According to the object of such a control slide valve, the latter executes very many lifting cycles, with the result that a high wear load occurs at the guide surfaces of the anti-twist device. Added to this is the fact that, owing to the fuel control performed by twisting of the pump piston, the control slide valve must be guided very exactly in twisting direction, so that a twisting backlash between control slide valve and cylinder sleeve has a great effect on the metering and injection timing accuracy of the fuel, it being possible for even a small backlash to lead to considerable deviations of the actual control from the setpoint control.

In the case of a known fuel injection pump of the generic type (EP-A-0 181 402), a pin is arranged on the wall of the clearance of the cylinder liner, which pin engages in a longitudinal guide groove of the control slide valve, with the result that, upon the axial displacement of the control slide valve, the latter is secured against twisting by pin and guide groove. Disregarding the fact that the distance between pin and piston axis is relatively small, whereby the lever distance preventing the twisting is also relatively short, the pin has only line contact or, with slight inclined position, point contact toward the groove wall, which leads to a relatively rapid wear, with the consequence of the disadvantageous twisting backlash and corresponding deterioration in the control accuracy of the fuel. A further disadvantage consists in that such a pin can be fixed relatively poorly in the wall of the clearance, whereby during a loosening of this pin considerable damages directly on the pump and indirectly on the engine were possible.

SUMMARY OF THE INVENTION

It is an object of the present invention to provide an improved fuel injection pump.

The fuel injection pump according to the invention has, in comparison, the advantage that the distance of the twisting guide point from the pump piston axis is increased, so that wear effects and thus backlash at the guide points have a lesser effect on the pump with respect to the associated twisting error of the control slide valve. The greater is the distance of the twisting guide from the piston axis, the smaller is the control error with a certain twisting backlash. With twice as long "lever guidance", the control error is only half as large with the same twisting backlash. A further advantage consists in that the anti-twist device according to the invention can be produced very inexpensively and is extremely sturdy and can be performed in terms of the precision working of this fit between lug and guide groove with simple customary working methods. A working loose of the lug from the control slide valve is not possible, with the result that no consequential damages in this respect can arise either. A further advantage consists in that the control slide valve is not additionally weakened by a groove or subjected to dimensional changes in heat treatment and during production on account of a groove, so that the "dynamic" slide valve durability is very good.

According to an advantageous development of the invention, the guide groove is designed as a slit-shaped perforation in the wall of the recess of the cylinder sleeve. Such a slit-like guide groove can be produced and worked in a simple way, the working in particular not taking place within the recess of the cylinder sleeve. A further advantage of this perforation in the wall of the cylinder sleeve consists in that it can be used for the fuel supply, with the result that, in the case of certain pump types with which these cylinder sleeves are arranged between a supply line and the suction space, additional connecting bores can be saved.

According to a further development of the invention, the lug has a rectangular longitudinal cross-section, measured in an imaginary plane which runs parallel to a tangential plane of the control slide valve and perpendicular to the longitudinal plane of symmetry of the lug, with the result that there are guide surfaces elongated in the adjustment direction of the lug toward the lateral limiting surfaces of the guide groove. According to one development of the invention, these guide surfaces are designed flat and parallel to the limiting surfaces of the guide groove, with the result that an area guidance is produced, with low Hertzian stress and correspondingly low wear. According to another development of the invention, the guide surfaces are designed slightly crowned (slightly convex), with the result that under a load there is an area contact between the lateral limiting surfaces of the guide groove and the guide surfaces of the lug. Such arrangements allow for a high force transmission with relatively low Hertzian stress and thus low wear. According to the invention, this line contact or else a surface contact, in which this surface has an as great as possible distance from the control slide valve, can be achieved in that the lug has a taper toward the control slide valve. Such a taper can be achieved for example by a relief cut or undercut.

According to a further advantageous development of the invention, the lug is arranged on one side of the control slide valve with respect to its displacement direction and the guide groove is correspondingly on one side in the cylinder sleeve. The effect achieved by this is that, when the fuel injection pump is installed, the control slide valve is always fitted in the correct installation position. With incorrect installation of the control slide valve, as can happen, for example in the case of symmetrical arrangement in longitudinal direction of the lug on the control slide valve, this is usually not discovered until the fuel injection pump is to be started up and the fuel control does not work at all or works completely incorrectly. This leads to high reworking costs in fabrication, as also in the case of incorrect installation during servicing, which is prevented by the development according to the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
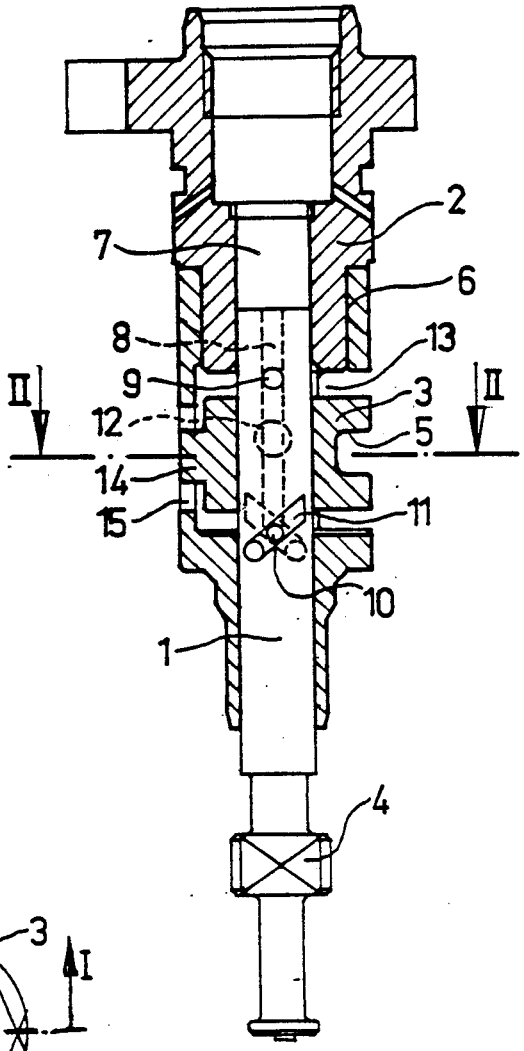
FIG. 1 shows a longitudinal section, through the parts, of an injection pump, namely through a pump element including control slide valve of the first embodiment along line I—I in FIG. 2.
Figure 2:
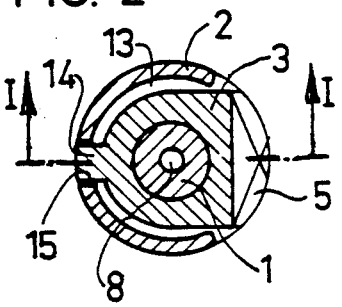
FIG. 2 shows a section along line II—II in FIG. 1.

In the embodiment shown in FIGS. 1 and 2, in each case only the pump element consisting of a pump piston 1 and a cylinder sleeve 2 as well as a control slide valve 3 is shown. As is known, this component is fitted in a fuel injection pump housing, in which the pump piston 1 can be set in a to and fro movement via a camshaft and against the force of a spring. At the lower end of the pump piston 1 is provided a flattened portion 4, on which a control rod (non-shown) for the twisting of this pump piston acts. A member for fuel control, likewise not shown, is an adjusting shaft, which engages by a pin in a transverse groove 5 of the control slide valve 3 and displaces the latter axially on the pump piston 1. In this embodiment, the cylinder sleeve 2 consists of two parts, which are fitted one in the other at 6 and are connected to each other for example by hard soldering or press-and-shrink fitting. Above the pump piston 1, there is in this cylinder sleeve 2 a pump working space 7, from which the fuel is conveyed via valves and lines (not shown) to the internal combustion engine. Furthermore, a central blind bore 8 is provided in the pump piston 1, which blind bore is crossed by a transverse bore 9 and a transverse bore 10. The transverse bore 10 is connected to oblique grooves 11 on the surface of the piston 1. In addition, radial bores 12 are provided in the annular slide valve 3.

The pump working space 7 is filled with fuel during the suction stroke and in the lower dead-center position shown, via the transverse bores 9, 10 and the axial bore 8, from a pump suction space 13, which surrounds in particular the control slide valve 3. In the compression stroke, fuel then flows back into the suction space 13, via the longitudinal bore 8, the transverse bore 9, the transverse bore 10 and the control grooves 11, until the transverse bore 9 enters the cylinder sleeve 2 or until these control grooves 11 enter the control slide valve 3. Only then does the actual injection to the internal combustion engine begin, which is thus dependent on the lift position of the control slide valve 3. This injection is interrupted when the oblique control edges 11 are activated by the radial bores 12 of the control slide valve 3 during the delivery stroke. Thereafter, the fuel flows out of the pump working space 7 via the axial bore 8, the transverse bore 10, the oblique grooves 11 and the radial bores 12, back into the suction space 13. Depending on the rotational position of the pump piston 1, i.e. depending on the relative position of the oblique grooves 11 with respect to the radial bores 12, this partial delivery stroke effective for injection is different.

The control slide valve 3 has on its rear surface facing away from the transverse groove 5 a lug 14, which is guided in a slit-shaped groove or perforation 15 of the cylinder sleeve 2. The lug 14 is arranged approximately in the center with respect to the longitudinal extension of the control slide valve 3. The side surfaces of the lug 14 and the guide surfaces of the perforation 15 facing said side surfaces of the lug run in parallel.

Figure 3:
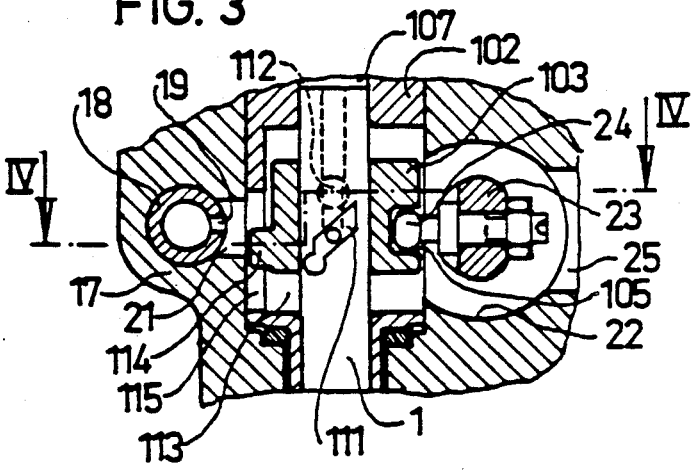
FIG. 3 shows a section corresponding to FIG. 1 through the second embodiment.
Figure 4:
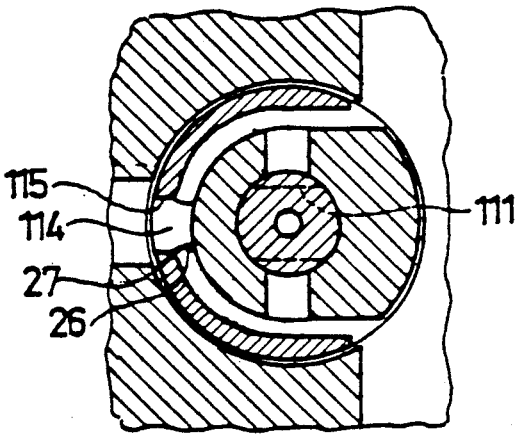
FIG. 4 shows a partial section along line IV—IV in FIG. 3.

In the second embodiment shown in FIGS. 3 and 4, the corresponding reference numbers have been increased by 100 and to this extent reference is made to the parts already described in the first embodiment. In addition to what was already shown in the first embodiment, in this embodiment a part of the pump housing 17 is shown, in which a supply pipe 18 for the fuel is installed, from which fuel can flow via a radial bore 19 and a recess 21 in the pump housing 17 and via the slit-shaped perforation 115 into the recess 113 of the cylinder sleeve 102, in which the control slide valve 103 is arranged axially movably. In this embodiment as well, the control slide valve 103 has a lug 114, which is guided in the slit-shaped perforation or groove 115. In addition, in the pump housing 17 is provided a longitudinal bore 22 of greater cross-section, which intersects the recess 113, with the result that an open connection is produced. This longitudinal bore 22 forms the actual suction space of the pump together with the recesses 113 of the individual cylinder sleeve 102, usually arranged in series. This suction space is supplied with fuel at low pressure by a delivery pump (not shown).

In the longitudinal bore 22 is arranged the adjusting shaft 23, on which there are pins 24, which engage in the transverse groove 105 of the control slide valve 103. An adjustment of each pin 24 is possible via an opening 25 in the pump housing 17, this opening 25 being closable by a plug (not shown). Thus, the pin 24 and an opening 25 are assigned to each of the individual control slide valves 103 arranged in series, with the result that a whole series of such pins 24 are arranged on the adjusting shaft 23.

The essential difference between this second embodiment and the first embodiment consists in that the lug 114 is offset asymmetrically downwards with respect to the longitudinal extension of the control slide valve 103, with corresponding positional arrangement of the perforation 115. This prevents the control slide valve 103 from being fitted the wrong way round, for example with the lug 115 upwards.

As can be seen in FIG. 4, a further distinction from the first embodiment consists in that the lug 114 has an undercut at 26, with the result that the actual contact surface between lug 114 and the guide surfaces of the slitshaped perforation 115 does not begin until the edge 27 forming the end of the undercut 26.

It will be understood that each of the elements described above, or two or more together, may also find a useful application in other types of fuel injection pumps differing from the types described above.

While the invention has been illustrated and described as embodied in a fuel injection pump it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Fuel injection pump for internal combustion engines, comprising a pump housing; at least one pump element including a pump cylinder formed as a cylinder sleeve and fixed in a corresponding bore of the pump housing, and a pump piston which is driven over a to and fro working stroke and can be twisted for fuel control; and at least one control slide valve positioned within a recess of the cylinder sleeve on the pump piston, said control slide valve having an anti-twist means and, for fuel control, can be displaced on the pump piston along an axis thereof, said anti-twist means including a lug (14, 114), formed on and projecting radially from the control slide valve (3, 103), and a guide groove (15, 115) formed in the cylinder sleeve (2, 102) and engaging the lug (14, 114), the guide groove (15, 115) being formed in a wall of the recess (13, 113) of the cylinder sleeve (2, 102), the lug (114) having a taper (26) toward the control slide valve (103).

2. Fuel injection pump for internal combustion engines, comprising a pump housing; at least one pump element including a pump cylinder formed as a cylinder sleeve and fixed in a corresponding bore of the pump housing, and a pump piston which is driven over a to and fro working stroke and can be twisted for fuel control; and at least one control slide valve positioned within a recess of the cylinder sleeve on the pump piston, said control slide valve having an anti-twist means and, for fuel control, can be displaced on the pump piston along an axis thereof, said anti-twist means including a lug (14, 114), formed on and projecting radially from the control slide valve (3, 103), and a guide groove (15, 115) formed in the cylinder sleeve (2, 102) and engaging the lug (14, 114), the guide groove (15, 115) being formed in a wall of the recess (13, 113) of the cylinder sleeve (2, 102), the guide groove being a slit-shaped perforation (15, 115) in the wall of the recess (13, 113) of the cylinder sleeve (2, 102), additionally serving for fuel supply.

3. Fuel injection pump for internal combustion engines, comprising a pump housing; at least one pump element including a pump cylinder formed as a cylinder sleeve and fixed in a corresponding bore of the pump housing, and a pump position which is driven over a to and fro working stroke and can be twisted for fuel control; and at least one control slide valve positioned within a recess of the cylinder sleeve on the pump piston, said control slide valve having an anti-twist means and, for fuel control, can be displaced on the pump piston along an axis thereof, said anti-twist means including a lug (14, 114), formed on and projecting radially from the control slide valve (3, 103), and a guide groove (15, 115) formed in the cylinder sleeve (2, 102) and engaging the lug (14, 114), the guide groove (15, 115) being formed in a wall of the recess (13, 113) of the cylinder sleeve (2, 102), the lug (114) being formed on one side of the control slide valve (103) with respect to a displacement direction thereof.

4. Fuel injection pump according to claim 3, wherein the guide groove (115) is formed on one side in accordance with a position of the lug.

5. Fuel injection pump according to claim 3, wherein a transverse groove (105) is provided in the control slide valve (103) for an engagement of a driving pin (24) for the axial displacement, and said transverse groove is formed on one side of the control slide valve (103) with respect to the direction of said displacement.

6. Fuel injection pump according to claim 3, wherein the guide groove is a slit-shaped perforation (15, 115) in the wall of the recess (13, 113) of the cylinder sleeve (2, 102).

7. Fuel injection pump according to claim 6, wherein the lug (14, 114) has a rectangular cross-section, defined in an imaginary plane which runs parallel to a tangential plane of the control slide valve and perpendicular to a longitudinal plane of symmetry of the lug (14, 114) so that guide surfaces on the lug extending toward lateral limiting surfaces of the guide groove (15, 115) are formed.

8. Fuel injection pump according to claim 3, wherein the lug (14, 114) has a rectangular cross-section, defined in an imaginary plane which runs parallel to a tangential plane of the control slide valve and perpendicular to a longitudinal plane of symmetry of the lug (14, 114), so that guide surfaces on the lug extending toward lateral limiting surfaces of the guide groove (15, 115) are formed.

9. Fuel injection pump according to claim 8, wherein the guide surfaces are flat, so that an area contact is produced between the lateral limiting surfaces on the guide groove (15, 115), and the guide surfaces of the lug (14, 114).

* * * * *